US006902375B2

(12) United States Patent
Bird et al.

(10) Patent No.: US 6,902,375 B2
(45) Date of Patent: Jun. 7, 2005

(54) QUICK CONNECT CEILING FAN BLADE

(75) Inventors: Gregory Michael Bird, Colliersville, TN (US); Masao Tsuji, Mesa, AZ (US)

(73) Assignee: Hunter Fan Company, Memphis, TX (US)

( * ) Notice: Subject to any disclaimer, the term of this patent is extended or adjusted under 35 U.S.C. 154(b) by 0 days.

(21) Appl. No.: 10/427,248

(22) Filed: May 1, 2003

(65) Prior Publication Data

US 2004/0219023 A1 Nov. 4, 2004

(51) Int. Cl.[7] ..... F04D 29/34

(52) U.S. Cl. ..... 416/207; 416/210 R; 416/214 R; 416/244 R

(58) Field of Search ..... 416/5, 62, 204 R, 416/207, 210 R, 214 R, 231 R, 244 R

(56) References Cited

U.S. PATENT DOCUMENTS

| | | | | |
|---|---|---|---|---|
| 4,187,056 | A | 2/1980 | Schwinn et al. | 416/207 |
| 4,197,054 | A | 4/1980 | Morrill | 416/93 R |
| 4,245,960 | A | 1/1981 | Matthews | 416/244 R |
| 5,102,302 | A | 4/1992 | Schilling et al. | 416/224 |
| 5,354,176 | A | 10/1994 | Schilling et al. | 416/204 R |
| 5,458,464 | A | 10/1995 | Lee | 416/210 R |
| 5,951,253 | A | 9/1999 | Gajewski | 416/214 R |
| 5,954,449 | A | 9/1999 | Wu | 403/315 |
| 5,980,353 | A | 11/1999 | Wu | 446/210 R |
| 6,010,306 | A | 1/2000 | Bucher et al. | 416/210 R |
| 6,022,191 | A | 2/2000 | Moore et al. | 416/134 R |
| 6,039,540 | A | 3/2000 | Wu | 416/210 R |
| 6,149,388 | A | 11/2000 | Liao | 416/210 R |
| 6,155,787 | A | 12/2000 | Hodgkins, Jr. | 416/210 R |
| 6,210,117 | B1 | 4/2001 | Bucher et al. | 416/210 R |
| 6,241,476 | B1 * | 6/2001 | Lee | 416/210 R |
| 6,250,885 | B1 | 6/2001 | Gajewski | 416/214 R |
| 6,352,409 | B1 * | 3/2002 | Blateri et al. | 416/210 R |
| 6,382,917 | B1 | 5/2002 | Zuege | 416/210 R |
| 6,390,777 | B1 | 5/2002 | Kerr, Jr. | 416/204 R |
| 6,508,629 | B2 | 1/2003 | Kerr, Jr. | 416/210 R |
| 2003/0099545 | A1 * | 5/2003 | Liang | 416/210 R |
| 2003/0228224 | A1 * | 12/2003 | Lee | 416/210 R |
| 2004/0208747 | A1 * | 10/2004 | Pearce | 416/210 R |

* cited by examiner

*Primary Examiner*—Edward K. Look
*Assistant Examiner*—Richard A. Edgar
(74) *Attorney, Agent, or Firm*—Baker Donelson

(57) ABSTRACT

A ceiling fan (10) is disclosed having a motor housing (11) with an electric motor (13) to which is mounted an annular array of blade irons (14) each having a blade (15) and a locking plate (17) mounted thereto. Each blade iron has three locking pins (26). Each locking pin has a shaft (27) extending to a head (28). Each blade 15 has three key-hole shaped locking pin mounting holes (31) extending therethrough, a top surface (32) and a pair of alignment pins (33) extending from the top surface. The three locking pin mounting holes are configured and oriented to receive the blade iron locking pins. Each locking plate has a top surface (36), three locking pin mounting holes (37), a pair of alignment pin slots (38) and a thumb tab (39). The three locking pin mounting holes are configured and oriented to receive and releasably lock with the blade iron locking pins. With the locking pins extending through the blade mounting holes and the locking plate mounting holes the locking plate is pushed outboard to its locked position preventing movement of the blade.

6 Claims, 3 Drawing Sheets

QUICK CONNECT CEILING FAN BLADE

TECHNICAL FIELD

This invention relates to ceiling fans and more specifically to mechanisms by which their fan blades are mounted and dismounted.

BACKGROUND OF THE INVENTION

Electrically powered ceiling fans typically have a motor mounted within a stationary housing that is suspended from a ceiling. In operation, the motor rotates an annular array of individual extensions in the form of blade irons. Each blade iron is associated with a blade mounted thereto.

Ceiling fans are usually sold at retail with their blades packed separately from the fan housing or blade irons for compactness. The housing is normally mounted in suspension from the ceiling through a downrod and then the blades are mounted to the blade irons. To do this, the blades have been mounted to the blade irons with screws or bolts. This has been cumbersome and tedious as the installer has had to be elevated on a ladder or platform and work above his head. This work has entailed aligning the mounting holes of the blade and blade iron and torguing the screws all while having to hold the blade above his head and often under poor lighting conditions. For blade replacement, the same task has been involved.

Ceiling fan blades have been designed to be coupled to a blade iron for quick mounting and dismounting, as shown in U.S. Pat. No. 6,010,306. This ceiling fan design shows a blade iron having three flat headed posts adapted to be slid into the narrow portion of key-hole shapes slots within the corresponding blade. The blade is prevented from moving by a spring blade lock which abuts the inward end of the blade. A problem however with this design is that the vibration or movement of the blade causes the flat head of the posts to rub against the blade, which oftentimes is made of a rather soft material such as wood. This rubbing may cause the deterioration of the blade adjacent the key hole slot, thereby causing a loose fitting or even the wearing through of the blade to such a degree as to cause the blade to dislodge from the underlying blade iron. This loosening of the blade is an obvious danger that should be avoided.

Accordingly, it is seen that a need remains for a ceiling fan capable of having its blades mounted and dismounted in a more efficient and easier manner. It is to the provision of such therefore that the present invention is primarily directed.

SUMMARY OF THE INVENTION

In a preferred form of the invention a ceiling fan comprises an electric motor and an annular array of blade irons mounted to the motor, each blade iron having a support member and at least one locking pin extending from the support member. The ceiling fan also has a ceiling fan blade associated with each blade iron of the annular array of blade irons, each blade having at least one locking pin mounting hole. Lastly, the ceiling fan includes a locking plate adapted to be releasably coupled to the locking pin as the locking pin extends through the locking pin mounting hole of the fan blade. With this construction, the blades may be mounted to the blade irons by passing the locking pin through the fan blade locking pin mounting hole and then coupling the locking plate to the locking pin to capture the fan blade between the blade iron and the locking plate.

DETAILED DESCRIPTION

Figure 1:
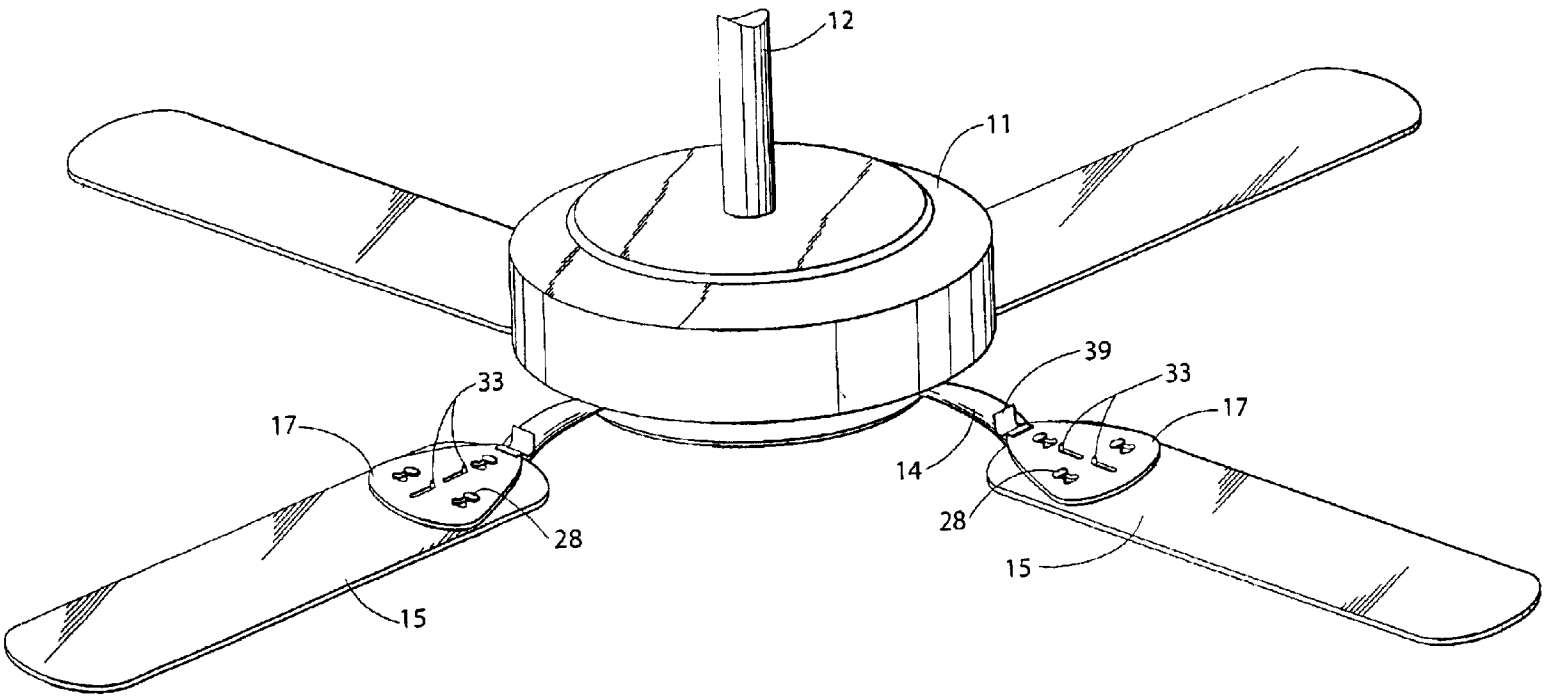
FIG. 1 is a perspective view of the top of a ceiling fan that embodies principles of the invention in its preferred form.
Figure 2:
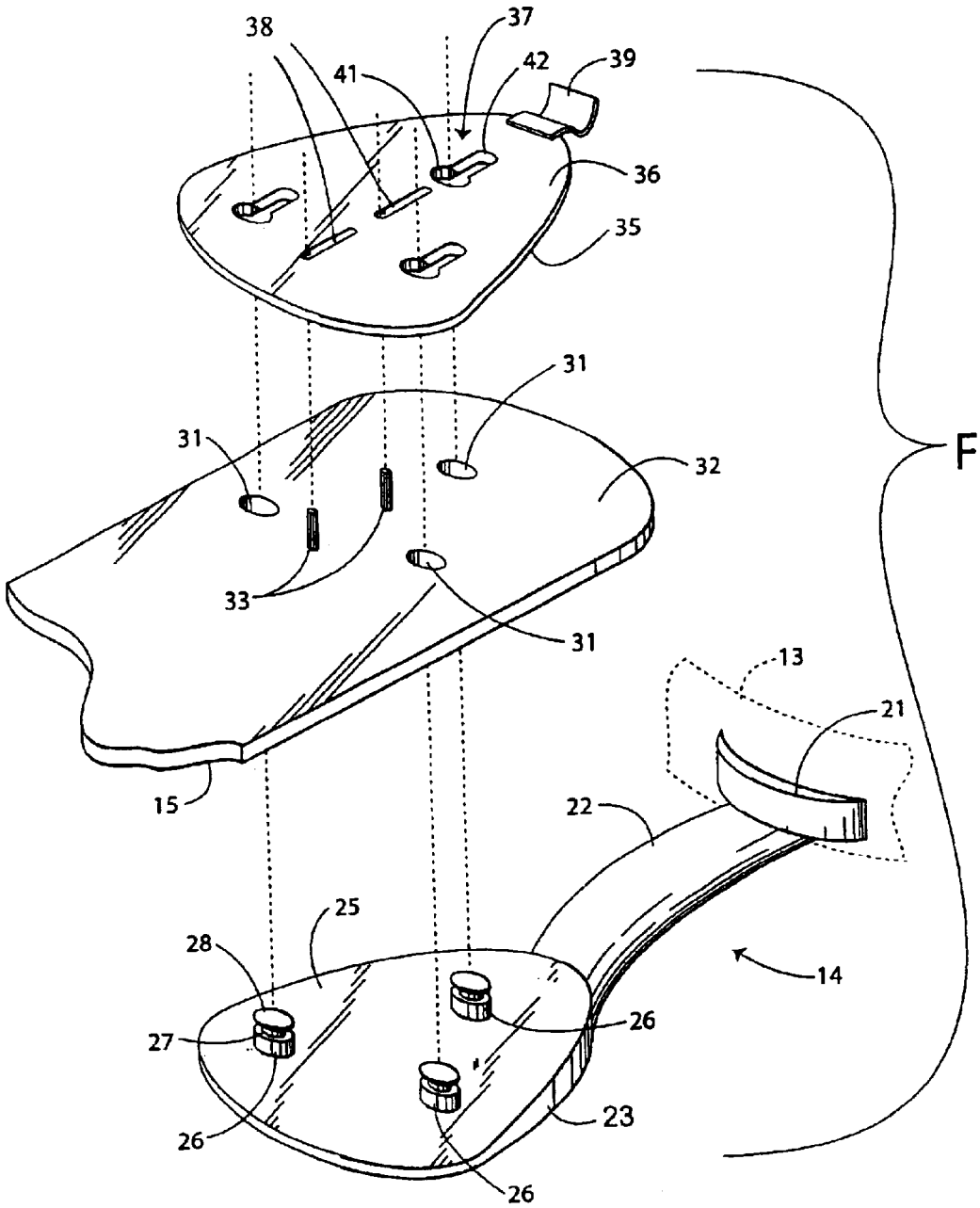
FIG. 2 is an exploded view of parts employed in mounting one of the fan blades.

With reference next to the drawings, there is shown a ceiling fan 10 having a motor housing 11 suspended from an unshown ceiling by a downrod 12. An electric motor 13 is mounted within the housing 11 and connected to a source of electric power by wires that extend through the downrod 12. The motor rotatably drives an annular array of blade irons 14, each having a blade 15 and a locking plate 17 coupled thereto.

Each blade iron 14 has a motor mounting flange 21 configured to be coupled with the electric motor 13 for rotation, a neck 22, and a blade support member or mounting portion 23. Each blade iron mounting portion 23 has a top surface or edge 25 and three mounting or locking pins 26 extending past the top surface 25 towards the ceiling. Each locking pin 26 has a stepped shaft 27 extending to a head 28 distal and set above the top surface 25. The head 28 has a width larger than the width of the shaft 27.

Each blade 15 has three locking pin mounting holes 31 extending therethrough, a top surface 32 and a pair of alignment pins 33 extending from the top surface 32. The three locking pin mounting holes 31 are configured and oriented to receive the blade iron locking pins 26.

Each locking plate 17 has a bottom surface 35, a top surface 36, three key-hole shaped locking pin mounting holes 37, a pair of alignment pin slots 38 and a thumb tab 39. The three locking pin mounting holes 37 are configured and oriented to receive and releasably lock with the blade iron locking pins 26. Each locking pin mounting hole 37 has an enlarged portion 41 configured to allow the passage of the locking pin head 28 therethrough and an elongated narrowed portion 42 configured to fit snugly about the locking pin shaft 27 beneath the head 28. The locking pin heads 28 are positioned a select distance from the top surface 25 of the blade iron 14 so that the blade 15 fits snugly between the head 28 and the top surface 25. The two alignment pin slots 38 are configured to receive the two blade alignment pins 33.

Figure 3:
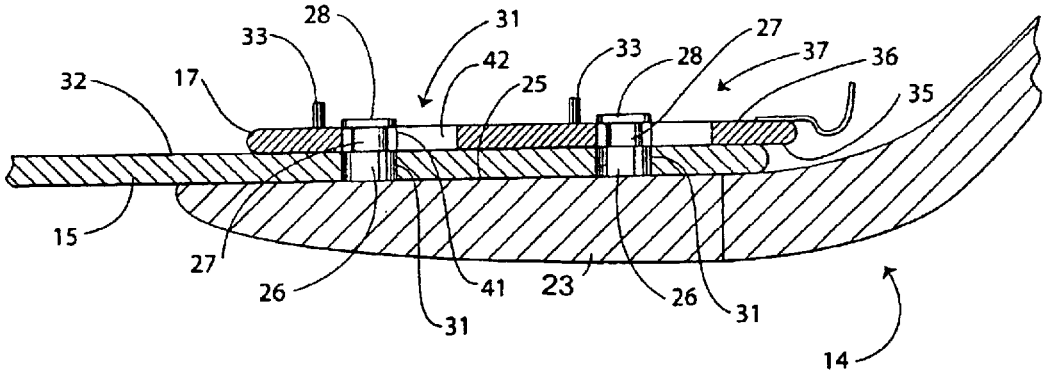
FIG. 3 is a cross-sectional view of the parts of FIG. 2 shown in an unlocked position

In use, the downrod 12 is coupled to the ceiling with the motor housing 11 coupled to the opposite end of the downrod with the blade irons 14 already mounted to the motor 13. Each blade 15 is mounted to a corresponding blade iron by lowering the blade 15 onto the underlying blade iron 14 so that the three locking pins 26 extend through the blade locking pin mounting holes 31. With the blade 15 resting upon the top surface 25 of the blade mounting portion 23 the locking plate 17 is then lowered onto the top surface 32 of the blade 15 with the locking pins 26 extending through the enlarged portion 41 of the blade locking pin mounting holes 37 and the blade alignment pins 33 extending through the alignment pin slots 38. The head 28 of the locking pins 26 should be positioned slightly above the top surface 36 of the locking plate 17, as shown by the unlocked position of the locking plate in FIG. 3.

Figure 4:
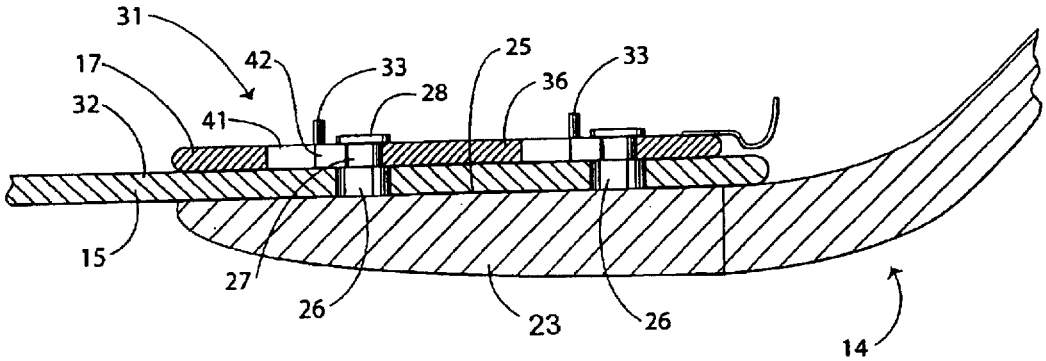
FIG. 4 is a cross-sectional view of the parts of FIG. 2 shown in a locked position.

Next, an installer manually pushes upon the thumb tab 39 of the locking plate 17 to slide the locking plate outboard to its locked position, thereby forcing the locking pins 26 into the narrowed portion 42 of the locking plate mounting holes 37, as shown in FIG. 4. The head 28 of the locking pins 26 should be pressed firmly against the top surface 36 of the locking plate to prevent relative movement of the locking plate. The term outboard is meant to represent movement away from the fan's axis of rotation.

With the locking pins 26 locked in position against the blade locking pin mounting holes 31 and the top surface 36 of the locking plate 17, the blade 15 is captured between the locking plate 17 and the blade mounting portion 23 of the blade iron 14. As such, the locking pins 26 prevent lateral movement of the blade 15 relative to the blade iron 14, i.e., locking the position of the blade 15 upon the blade iron 14. This locking of the blade may be accomplished simply and quickly by a single installer as this may be done without the use of tools and without screwing in multiple mounting screws. The ability to lock the blades in place without the use of tools solves a problem long associated with mounting the blades of ceiling fans of the prior art.

It should be understood that the use of a locking plate 17 spreads the contact surface between the locking means between the blade and the blade iron onto a large contact surface area. By enlarging this contact surface area any vibration or other movement of the components during fan operation does not result in the eventual wearing down of the contact surfaces, which may cause the loosening of the blade from the blade iron. Again, the elimination of the wearing problem solves another problem long associated with the prior art.

The blade 15 may likewise be dismounted from the blade iron 14 by simply moving the locking plate 17 inboard to a position wherein the locking pin heads 28 may pass back through the enlarged portion 41 of the locking plate mounting holes 37 and blade mounting holes 31. This may be accomplished by an operator pressing inboard upon the locking plate thumb tab 39.

The stepped shaft 27 of the locking pins 26 allow the lowermost portion to fit snugly within the blade mounting holes 31 while having the thinner portion exposed above the top surface 32 of the blade so as to fit snugly within the narrowed portion 42 of the locking plate mounting holes 37. This stepped structure aids in maintaining a tight fit between all the components.

It should be understood that while the preferred embodiment of the invention shows the use of three locking pins, such should not be considered to be a limitation regarding the number of locking pins. Alternative designs of the present invention may utilize any number of locking pins. Also, it should be understood that the alignment pins are utilized to aid in the movement of the locking plate between a locked and unlocked position. However, these alignment pins may be eliminated while still practicing the invention.

It thus is seen that a quick connect ceiling fan blade is now provided which enables the blade to be mounted and dismounted easily, quickly and in a reliable and secure manner. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A ceiling fan comprising, an electric motor;

an annular array of blade irons mounted to said motor, each said blade iron having a support member and at least one locking pin extending from said support member, said locking pin has a head distal said support member and a shaft;

a ceiling fan blade associated with each said blade iron of said annular array of blade irons, each said blade having at least one locking pin mounting hole; and a locking plate adapted to be releasably coupled to said locking pin as said locking pin extends through said fan blade locking pin mounting hole, said locking pin head is configured to overlay said locking plate, each said locking plate has at least one hole having an enlarged portion configured to allow the passage of said locking pin there through and an elongated narrowed portion configured to fit snugly about said locking pin shaft beneath said head, and at least one aligning pin associated with each said blade and wherein said locking plate includes an elongated aligning slot configured to receive said at least one aligning pin, whereby the blades may be mounted to the blade irons by passing the locking pin through the fan blade locking pin mounting hole and then coupling the locking plate to the locking pin to capture the fan blade between the blade iron and the locking plate.

2. The ceiling fan of claim 1 wherein said at least one aligning pin extends from said blade.

3. A ceiling fan comprising, an electric motor;

an annular array of blade irons mounted to said motor, each said blade iron having a support member and at least one locking pin extending from said support member;

a ceiling fan blade associated with each said blade iron of said annular array of blade irons, each said blade having at least one locking pin mounting hole; and a locking plate adapted to be releasably coupled to said locking pin as said locking pin extends through said fan blade locking pin mounting hole, and at least one aligning pin associated with each said blade and wherein said locking place includes an elongated aligning slot configured to receive said at least one aligning pin, whereby the blades may be mounted to the blade irons by passing the locking pin through the fan blade locking pin mounting hole and then coupling the locking plate to the locking pin to capture the fan blade between the blade iron and the locking plate.

4. A ceiling fan comprising, an electric motor;

an annular array of blade irons mounted to said motor, each said blade iron having a plurality of locking pins, each said locking pin has a head distal said support member and a shaft;

a ceiling fan blade associated with each said blade iron of said annular array of blade irons, each said blade having a plurality of locking pin holes configured to receive said blade iron locking pins; and a locking plate having a plurality of locking pin receivers adapted to releasably mate with said blade iron locking pins, wherein said locking pin head is configured to overlay said locking plate, said locking plate having a plurality of holes, each hole having an enlarged portion configured to allow the passage of said locking pin there through and an elongated narrowed portion configured to fit snugly about said locking pin shaft beneath said head; and at least one aligning pin associated with each said blade and wherein said locking plate includes an elongated aligning slot configured to receive said aligning pin, whereby the blades may be mounted to the blade irons by passing the locking pins through the fan blade locking pin mounting holes and then mating the locking plate to the locking pins.

5. The ceiling fan of claim 4 wherein said at least one aligning pin extends from said blade.

6. A ceiling fan comprising, an electric motor;

an annular array of blade irons mounted to said motor, each said blade iron having a plurality of locking pins;

a ceiling fan blade associated with each said blade iron of said annular array of blade irons, each said blade having a plurality of locking pin holes configured to receive said blade iron locking pins; and a locking plate having a plurality of locking pin receivers adapted to releasably mate with said blade iron locking pins, and at least one aligning pin associated with each said blade and wherein said locking plate includes an elongated aligning slot configured to receive said at least one aligning pin, whereby the blades may be mounted to the blade irons by passing the locking pins through the fan blade locking pin mounting holes and then mating the locking plate to the locking pins.

* * * * *